US005655944A

United States Patent [19]

Fusselman

[11] Patent Number: 5,655,944

[45] Date of Patent: Aug. 12, 1997

[54] PACKAGING APPARATUS AND AERIAL DEVICE FORMED FROM SHEET MATERIAL

[76] Inventor: Robert M. Fusselman, 483 Green Garden Dr., Youngstown, Ohio 44512

[21] Appl. No.: 613,453

[22] Filed: Mar. 1, 1996

[51] Int. Cl.[6] ..... A63H 27/00; A63H 33/16

[52] U.S. Cl. ..... 446/67; 206/475; 446/79

[58] Field of Search ..... 206/475, 521.1, 206/521.2; 40/124.1, 312; 446/67, 79, 80, 34, 68

[56] References Cited

U.S. PATENT DOCUMENTS

| | | | |
|---|---|---|---|
| D. 240,437 | 7/1976 | Rizzo . | |
| D. 310,251 | 8/1990 | Kenyan et al. . | |
| D. 347,032 | 5/1994 | Nieder . | |
| 2,154,487 | 4/1939 | Bonnell | 445/68 X |
| 2,463,135 | 3/1949 | Bach . | |
| 2,784,524 | 3/1957 | Jackle . | |
| 3,519,189 | 7/1970 | Bombara et al. | 206/521.1 |
| 3,898,763 | 8/1975 | Rizzo . | |
| 4,014,251 | 3/1977 | Meyer et al. | 446/67 X |
| 4,195,439 | 4/1980 | Kramer | 446/68 |
| 4,301,614 | 11/1981 | Newton | 446/68 |

FOREIGN PATENT DOCUMENTS

| | | | |
|---|---|---|---|
| 643205 | 9/1950 | United Kingdom | 446/68 |

*Primary Examiner*—Mickey Yu
*Assistant Examiner*—D. Neal Muir
*Attorney, Agent, or Firm*—Parsons & Goltry; Robert A. Parsons; Michael W. Goltry

[57] ABSTRACT

An aerial device capable of sustained flight and formed from a single sheet of substantially planar material and having a weight element receivable thereon for aiding the aerial device in achieving superior flight characteristics.

8 Claims, 2 Drawing Sheets

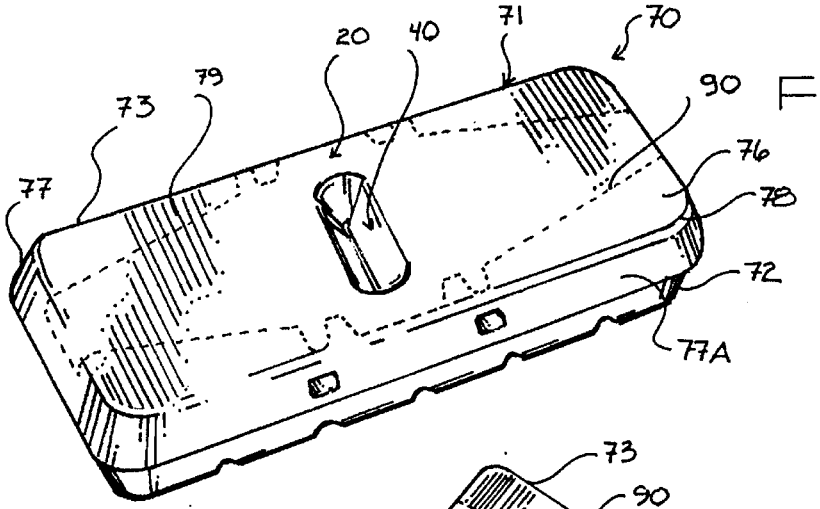
FIG. 6
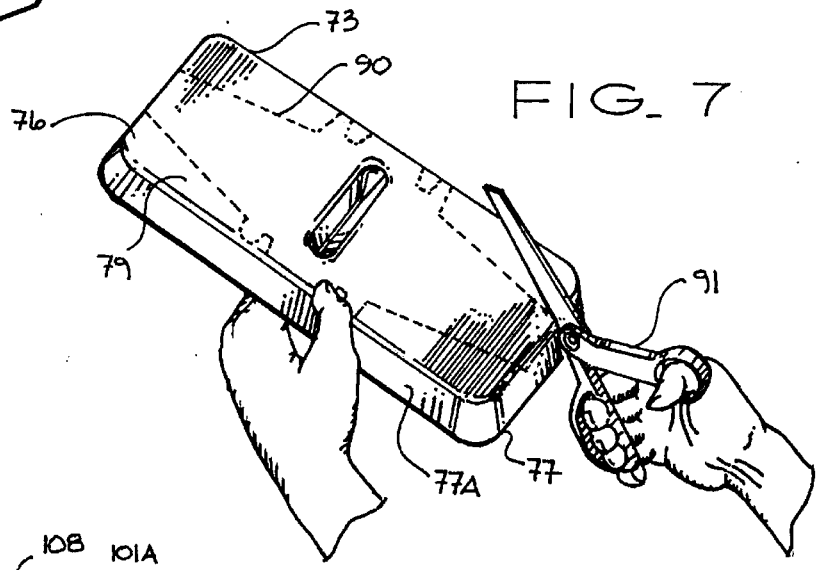
FIG. 7
FIG. 8
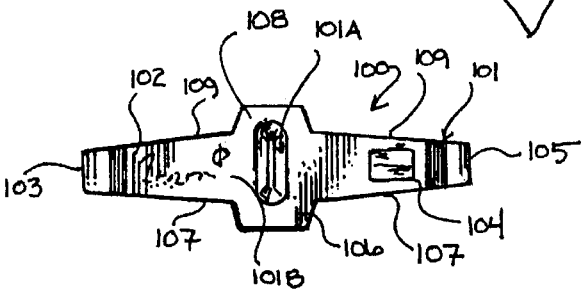
FIG. 9
FIG. 10
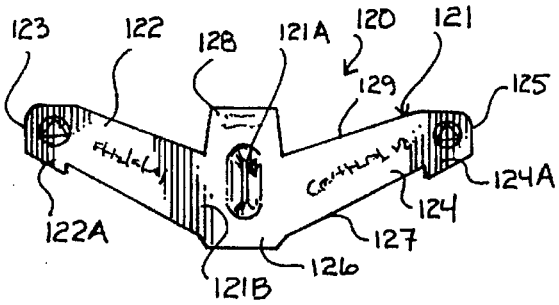
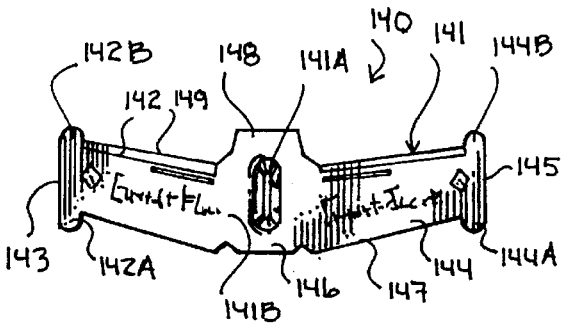

PACKAGING APPARATUS AND AERIAL DEVICE FORMED FROM SHEET MATERIAL

BACKGROUND OF THE INVENTION

1. Field of the Invention

This invention relates to aerial devices.

More particularly, this invention relates to aerial devices formed from a single piece of substantially planar sheet material.

In a further and more specific aspect, the instant invention relates to an aerial device formed from a single piece of substantially planar sheet material provided from a packaging apparatus.

2. Prior Art

Aerial devices such as airplanes and gliders are well known and are normally provided with an array of distinct designs and configurations. An airplane is normally defined as any of a class of fixed-wing aircraft that is heavier than air, propelled by a screw propeller or a high-velocity jet, and supported by the dynamic reaction of the air against its wings. Similarly, a glider is normally defined as non-powered heavier-than-air craft capable of sustained flight. With respect to gliders, there exist an array of model-type or miniature gliders available from toy stores and other such commercial establishments for use in play by children and adults. These model gliders are not only constructed of a wide variety of materials such as paper, corrugated paper, Styrofoam, plastic, and other such substances, they are further provided with varying designs and configurations for the purposes of enhancing the visual appearance of the aircraft, and in some cases the unique flying characteristics.

Typical with model or miniature gliders, great care is taken with respect to the manufacture and the selection of materials for use in their construction. Careful materials selection and construction is essential to ensure proper and high quality flight characteristics of such model gliders, and to prevent wear or breakage resulting from extended or prolonged use. Although these types of model or miniature gliders are exemplary and highly impressive, they are normally expensive to manufacture, and do not fly particularly well after a minimal amount of wear and tear resulting from use. As a consequence, there is a need in the prior art to provide a miniature or model aerial device that not only possesses excellent flying characteristics, but is also very inexpensive and easy to manufacture, and quite resilient.

Consistent with the above, most known miniature or model gliders are either manufactured from a plurality of separate and distinct parts, or perhaps integrally molded from substances such as Styrofoam. However, none that are known are formed directly from or merely lifted or removed from a single sheet of substantially planar sheet material, without folding or otherwise manipulating the material itself to form the model glider. If such a glider could be constructed in such a way, it would be very inexpensive indeed.

Furthermore, the prior art provides a wide range of packaging apparatus. Examples of prior art packaging apparatus include cardboard boxes, egg cartons constructed of Styrofoam or paper-type materials, plastic containers, paper boxes, and a multitude of others. These prior art packaging apparatus, while useful for packaging and transporting an array of items, have little or no usefulness beyond the intended use for which they were constructed. Accordingly, there exists a deficiency in the prior art to create a packaging apparatus having functional utility beyond merely packaging and transporting various items.

It would be highly advantageous, therefore, to remedy the foregoing and other deficiencies inherent in the prior art.

Accordingly, it is an object of the present invention to provide a new and useful aerial device of the model or miniature variety.

Another object of the present invention is to provide a new and useful aerial device that is easy to manufacture.

And another object of the present invention is to provide a new and useful aerial device that is very inexpensive to manufacture.

Still another object of the present invention is to provide a new and useful packaging apparatus.

Yet another object of the instant invention is to provide a new and useful packaging apparatus having portions including a new and useful aerial device expressed therewith.

Yet still another object of the instant invention is to provide a new and useful method for forming an aerial device from a sheet of generally planar sheet material.

And a further object of the invention is to provide a new and useful packaging apparatus having a new and useful aerial device incorporated therewith.

Still a further object of the immediate invention is to provide a Styrofoam egg carton that may be easily modified to form a new and useful aerial device.

Yet a further object of the invention is to provide a Styrofoam egg carton incorporating a new and useful aerial device, and that is inexpensive to manufacture.

And still a further object of the invention is to provide a Styrofoam egg carton incorporating a new and useful aerial device, and that is easy to manufacture.

SUMMARY OF THE INVENTION

Briefly, to achieve the desired objects of the instant invention in accordance with a preferred embodiment thereof, first provided is an aerial device capable of sustained flight and formed from a single sheet of substantially planar material. The aerial device includes portions for receiving a weight element for aiding the aerial device in achieving superior flight characteristics.

Also included is a method for forming an aerial device from a sheet of substantially planar material. The method includes the steps of providing the sheet of substantially planar material, expressing an outline of the aerial device on a substantially planar surface of the sheet of substantially planar material, and removing the aerial device from the sheet of substantially planar material.

Next provided is a packaging apparatus for retaining selected items. The packaging apparatus is preferably comprised of a conventional Styrofoam egg carton having a lid with a substantially planar sheet portion. The preferred packaging apparatus further includes the expression of an aerial device formed proximate a substantially planar surface of the substantially planar sheet portion and being removable therefrom.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 6 is a perspective view of an alternate embodiment of the instant invention;

FIG. 7 is a view of a lid portion of the alternate embodiment depicted in FIG. 6, with portions of the lid portion being cut into with conventional scissors;

FIG. 8 is yet another alternate embodiment of the instant invention similar to the preferred embodiment first depicted in combination with FIG. 1;

FIG. 9 is yet still another alternate embodiment of the instant invention similar to the preferred embodiment first depicted in combination with FIG. 1; and FIG. 10 is still another alternate embodiment of the instant invention similar to the preferred embodiment first depicted in combination with FIG. 1.

DETAILED DESCRIPTION OF THE PREFERRED EMBODIMENTS

Figure 1:
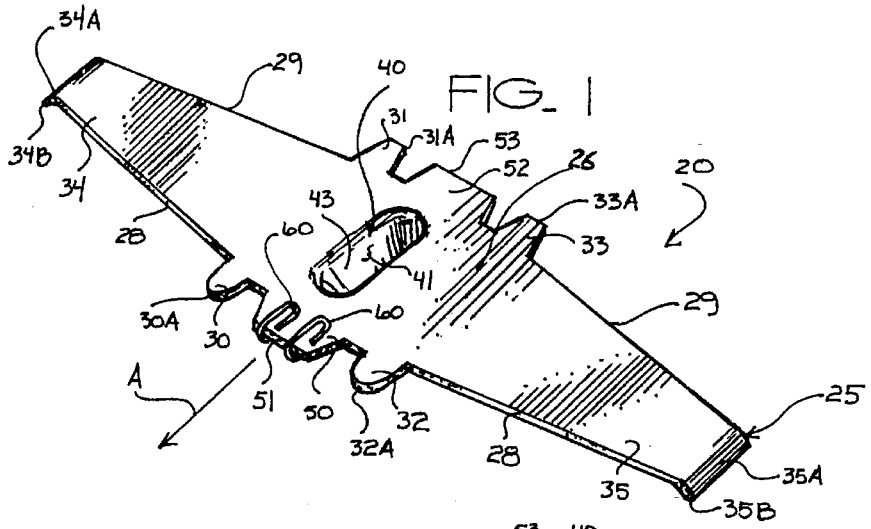
FIG. 1 is a perspective view of an embodiment of the instant invention constructed in accordance with the preferred embodiment.

Turning now to the drawings, in which like reference characters indicate corresponding elements throughout the several views, attention is first directed to FIG. 1 which illustrates a first embodiment of the instant invention comprising an aerial device being generally designated by the reference character 20. Aerial device 20 includes an elongate wing element 25 which is preferably substantially planar and integrally molded. Preferably constructed of Styrofoam, aerial device 20 functions as a glider for facilitating non-powered sustained flight.

Figure 2:
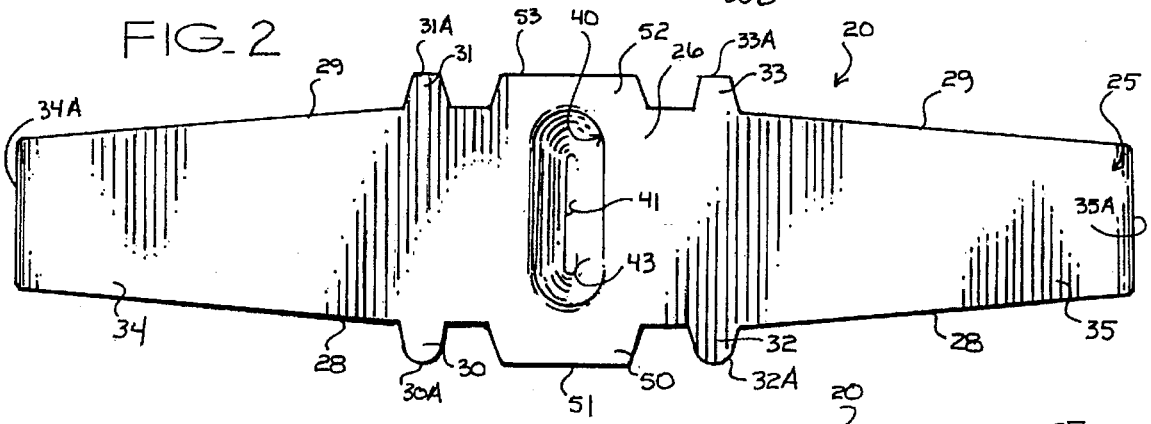
FIG. 2 is a top plan view of the embodiment depicted in FIG. 1.
Figure 3:
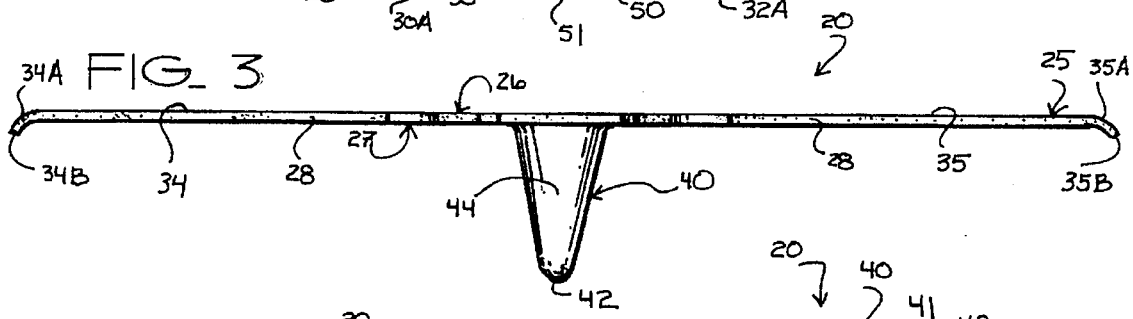
FIG. 3 is a front elevational view of the embodiment depicted in FIG. 1.
Figure 4:
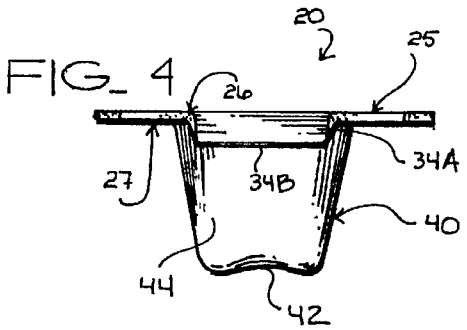
FIG. 4 is a side elevational view of the embodiment depicted in FIG. 1.

With continuing reference to FIG. 1, and additional reference to FIG. 2, FIG. 3, and FIG. 4, elongate wing element 25 includes an upper surface 26, a lower surface 27, a forward edge 28, and a rearward edge 29. Elongate wing element 25 further includes a first wing member 34 having an outer end defined by a generally downwardly extending portion 34A terminating with a lower edge 34B, and a second wing member 35 having an outer end defined by a generally downwardly extending portion 35A terminating with a lower edge 35B. First wing member 34 and second wing member 35 are integrally molded and are disposed in a laterally opposite and outwardly extending configuration relative one another. With respect to the preferred wing configuration of the preferred embodiment of elongate wing element 25, first wing member 34 and second wing member 35 are generally outwardly tapered. Although first wing member 34 and second wing member 35 of elongate wing element 25 have been illustrated as being generally outwardly tapered and outwardly laterally disposed relative each other, it will be appreciated by those of ordinary skill in the art, that other wing shapes and configurations, such as a swept back wing configuration discussed herein, may be employed without departing from the nature and scope of the instant invention as herein disclosed. Generally downwardly extending portion 34A and generally downwardly extending portion 35A function as a means for stabilizing aerial device 20 during flight.

As can be seen in FIG. 1 and FIG. 2, elongate wing element 25 further includes a first forwardly extending protrusion 30 and a first opposing rearwardly extending protrusion 31, and a second forwardly extending protrusion 32 and a second opposing rearwardly extending protrusion 33, all of which are integrally formed with elongate wing element 25. First and second forwardly extending protrusions, 30 and 32, can be seen as extending forwardly from portions of forward edge 28 and each terminating with a generally rounded outer end, 30A and 32A respectively. In similar fashion, first and second rearwardly extending protrusions, 31 and 33, can be seen as extending rearwardly from portions of rearward edge 29 and each terminating with a generally flat outer end, 31A and 33A respectively. First and second forwardly extending protrusions, 30 and 32, and first and second rearwardly extending protrusions, 31 and 33, are not only decorative, but also add stability to aerial device 20 during flight. It will be understood that aerial device 20 may be constructed without first and second forwardly extending protrusions, 30 and 32, and first and second rearwardly extending protrusions, 31 and 33, without departing from the nature and scope of the instant invention, and without inhibiting the impressive aerial flying characteristics of the instant invention.

Figure 5:
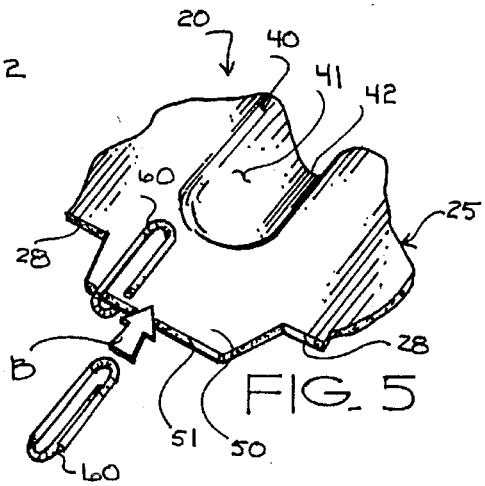
FIG. 5 is an enlarged fragmentary perspective view of portions of the embodiment depicted in FIG. 1.

With continuing reference to the above referenced figures, and additional reference to FIG. 5, integrally formed with elongate wing element 25 and at a generally intermediate position thereof is seen a molded aspect defined as a depression 40 extending from breech 41 and further in a generally downwardly direction away from lower surface 27. Further, depression 40 includes a generally inwardly tapered configuration and terminates with a closed end 42. Depression 40 further includes an inner surface 43 and an outer surface 44, and further functions as a gripping body operative for gripping or holding aerial device 20 for selectively throwing aerial device 20 into the air for facilitating flight of aerial device 20.

With attention directed specifically to FIG. 1, FIG. 2 and FIG. 5, disposed proximate a generally intermediate position proximate elongate wing element 25 and further disposed intermediate first and second forwardly extending protrusions, 30 and 32, is seen a generally forwardly extending central protrusion 50 which terminates with a leading edge 51. Forwardly extending central protrusion 50 is integrally formed with elongate wing element 25 and extends outwardly and forwardly from forward edge 28. Similarly situated proximate a generally intermediate position proximate elongate wing element 25 and further disposed intermediate first and second rearwardly extending protrusions, 31 and 33, is seen a generally rearwardly extending central protrusion 52 which terminates with a rearward edge 53. Like forwardly extending central protrusion 50, rearwardly extending central protrusion 52 is also integrally formed with elongate wing element 25 and extends outwardly and rearwardly from rearward edge 29.

As illustrated in FIG. 1 and FIG. 5, forwardly extending central protrusion 50 is operative for receiving a weight element, of which, in accordance with the preferred embodiment, is comprised of conventional paper-clips, each paper-clip being detectably engaged or received by forwardly extending central protrusion 50 proximate forward edge 28 at a generally intermediate position thereof, and each being designated by the reference character 60. Each paper-clip 60, when disposed in the direction indicated by arrow B in FIG. 5, is received and retained by forwardly extending central protrusion, details of the operation of each paper-clip 60 of which will not be herein addressed as paper-clips and their operation are well known. Each paper-clip 60, when carried by forwardly extending central protrusion 50, function as a stabilizing means for stabilizing and balancing said elongate wing element 25 during flight in the direction indicated by arrowed line A in FIG. 1, thereby aiding aerial device 20 in achieving excellent flight characteristics.

The weight element, herein specifically described as one of a plurality of paper-clips, may be selectively coupled proximate forward edge 28, or perhaps rearward edge 29 proximate rearwardly extending central protrusion 52, for enhancing the operative flight characteristics of aerial device 20. It will be readily understood by those having ordinary skill in the art, that the paper-clips may be coupled to other portions of aerial device 20, such as rearwardly extending central protrusion or proximate rearward edge 29 at a generally intermediate position thereof, for enhancing the general flight characteristics of aerial device 20 without departing from the nature and scope of the instant invention as herein disclosed. Furthermore, although one of a plurality of paper-clips has been herein disclosed as being the preferred stabilizing means or weight element for use in combination with the instant invention, it will be readily appreciated that other objects having similar characteristics may be used in lieu thereof, such as perhaps conventional tacks piercingly retained therethrough relevantly indicated and above-referenced portions, or other like devices having similar characteristics.

Reference is now directed to FIG. 6, which illustrates how aerial device 20 may be incorporated in combination with a packaging apparatus, the packaging apparatus being generally designated by the reference character 70. Packaging apparatus 70, herein specifically shown as the preferred packaging apparatus, is comprised of a conventional Styrofoam egg carton 71, details of which are well known to those having ordinary skill and will not be herein specifically discussed in exhausting detail.

However, egg carton 71 is generally comprised of a base 72 for holding a plurality of eggs (not herein specifically shown), and a lid 73 hingedly coupled (not herein specifically shown) to portions of base 72. Lid 73, being integrally formed, includes, among other structural elements not herein specifically discussed, a substantially planar sheet portion 76 having a generally downwardly and outwardly extending continuous sidewall 77 coupled to a peripheral edge 78 thereof, continuous sidewall 77 further having a continuous outer surface 77A. Substantially planar sheet portions 76, having a predetermined thickness, further includes a molded aspect, that being depression 40 discussed above, and a substantially planar outer surface 79.

Disposed proximate portions of continuous outer surface 77A and substantially planar outer surface 79 of lid 73 is further included an outline 90 specifically configured to express or form the shape of aerial device 20 first illustrated in combination with FIG. 1. As can be seen with reference to FIG. 7, aerial device 20 as herein specifically described in combination with FIGS. 1 through 5, the form of which being expressed upon portions of lid 73, may be selectively removed from lid 73 by cutting through portions of continuous sidewall 77 and substantially planar sheet portion 76 along outline 90 formed thereon with conventional scissors 91 as shown. Outline 90 may be expressed by means of dotted lines formed thereon as shown, a continuous line drawn thereon, a plurality of lines drawn thereon, or perhaps a plurality of perforate openings to form a plurality of perforate lines from which aerial device 20 could be torn or punched away from lid 73.

Attention is now directed to FIG. 8, FIG. 9, and FIG. 10, all of which are intended to illustrate that a variety of designs may be incorporated into the aerial devices. In particular, aerial device 100 shown in FIG. 8, being of substantially the same construction as aerial device 20 first shown in combination with FIG. 1, is comprised of a substantially planar elongate wing element 101 having a centrally disposed integrally molded depression 101A, a substantially planar upper surface 101B, a substantially planar lower surface (not herein specifically shown), a first wing member 102 having an outer end 103 and a second wing member 104 having an outer end 105, first wing member 102 and second wing member 104 being integrally molded and laterally opposite and outwardly extending relative one another. With respect to this embodiment, first wing member 102 and second wing member 104 are generally outwardly tapered. Like aerial device 20, and having the same functional characteristics, aerial device 100 further includes a forwardly extending central protrusion 106 extending from a forward edge 107, and a rearwardly extending central protrusion 108 extending from a rearward edge 109 thereof.

With respect to FIG. 9, aerial device 120, being of substantially the same construction as aerial device 20 first shown in combination with FIG. 1, is comprised of a substantially planar elongate wing element 121 having a centrally disposed integrally molded depression 121A, a substantially planar upper surface 121B, a substantially planar lower surface (not herein specifically shown), a first wing member 122 being generally outwardly tapered and having an outer end 123, and a second wing member 124 being generally outwardly tapered and having an outer end 125, first wing member 122 and second wing member 124 being integrally molded and extending laterally opposite and outwardly divergent relative one another, in what is commonly referred to as a swept-back wing configuration. Like aerial device 20, and having the same functional characteristics, aerial device 120 further includes a forwardly extending central protrusion 126 extending from a forward edge 127, and a rearwardly extending central protrusion 128 extending from a rearward edge 129 thereof. Also shown integrally formed with first wing member 122 and second wing member 124 are forwardly extending wing projections, 122A and 124A respectively, each forwardly extending wing projection, 122A and 124*a*, being disposed proximate the respective outer ends, 123 and 125 respectively. Forwardly extending wing projections, 122A and 124A, each function as not only wing stabilizers for stabilizing aerial device 120 during flight and aiding aerial device 120 to achieve superior flying characteristics, but also incorporate a decorative affect.

Like aerial device 120, aerial device 140 shown in FIG. 10, being of substantially the same construction as aerial device 120 and aerial device 20 first shown in combination with FIG. 1, is comprised of a substantially planar elongate wing element 141 having a centrally disposed integrally molded depression 141A. Substantially planar elongate wing element further includes a substantially planar upper surface 141B, a substantially planar lower surface (not herein specifically shown), a first wing member 142 being generally tapered and having an outer end 143, and a second wing member 144 being generally tapered and having an outer end 145, first wing member 142 and second wing member 144 being integrally molded and extending laterally opposite and outwardly divergent relative one another, in what is commonly referred to as a swept-back wing configuration. Like aerial device 20, and having the same functional characteristics, aerial device 140 further includes a forwardly extending central protrusion 146 extending from a forward edge 147, and a rearwardly extending central protrusion 148 extending from a rearward edge 149 thereof. Also shown integrally formed with first wing member 142 and second wing member 144 are forward protrusions, 142A and 144A respectively, and opposing rearward projections, 142B and 144B respectively, each forward protrusion, 142A and 144A, and each rearward protrusion, 142B and 144B, being disposed proximate the respective outer ends, 143 and 145 respectively. Forward protrusions, 142A and 142B, and rearward protrusions, 142B and 144B, function as not only wing stabilizers for stabilizing aerial device 120 during flight and aiding aerial device 120 to achieve superior flying characteristics, but also incorporate a decorative affect.

It will be readily understood by those having ordinary skill in the art that each aerial device as disclosed, is preferably constructed of substantially planar sheet material such as preferably Styrofoam, or other similar composition having similar structural and functional characteristics. The benefit of using Styrofoam as the preferred material is that it is resilient, strong, light, inexpensive, and withstands damage throughout extended or prolonged use. Similarly, each aerial device as disclosed may be formed, extracted or removed, quite easily from a single piece of substantially planar sheet material, whether it be the lid of a conventional Styrofoam egg carton, or other preferred and suitable source. Furthermore, although the preferred packaging apparatus has been herein disclosed as a conventional egg carton, it will be readily appreciated by those having ordinary skill that other packaging apparatus having substantially similar characteristics for the formation of an aerial device as disclosed may be use or employed.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An integrally formed aerial device consisting essentially of:

a substantially planar unitary elongate wing element formed from a lid of an egg carton, said elongate wing element having:

a first end, a second end, an upper surface, a lower surface, a forward edge, and a rearward edge; and stabilizing means, detectably engageable proximate said elongate wing element for stabilizing and balancing said substantially planar elongate wing element during flight and for aiding said aerial device in achieving excellent flight characteristics.

2. The integrally formed aerial device of claim 1, wherein said substantially planar wing element further includes an integrally formed gripping body extending generally downwardly from said lower surface proximate a generally intermediate position of said wing element and terminating with a lower end, said gripping body for gripping and holding said wing element for throwing.

3. The integrally formed aerial device of claim 1, wherein said stabilizing means includes a weight element received by portions of said leading edge at a generally intermediate position of said substantially planar elongate wing element.

4. A method of forming a unitary aerial device consisting essentially of a wing from an egg/carton including a lid having a substantially planar sheet portion, said method comprising the steps of:

providing an egg carton including a lid having a substantially planar sheet portion;

expressing an aerial device upon portions of said substantially planar sheet portion; and removing said aerial device from said substantially planar sheet portion.

5. The method of claim 4, wherein said step of expressing said aerial device upon portions of said sheet further includes the step of forming an outline of said aerial device on a substantially planar surface of said sheet.

6. The method of claim 5, wherein said step of forming said outline of said aerial device on said substantially planar surface of said sheet further includes the step of forming a plurality of perforate openings through said sheet.

7. The method of claim 5, wherein said step of removing said aerial device from said sheet includes the step of cutting along said outline to cut away portions of said sheet to form said aerial device.

8. The method of claim 6, wherein said step of removing said aerial device from said sheet includes the step of tearing said sheet along said perforate openings to remove said aerial device therefrom.

* * * * *